US007296818B2

(12) United States Patent
Krumbeck et al.

(10) Patent No.: US 7,296,818 B2
(45) Date of Patent: Nov. 20, 2007

(54) COMBINATION OF SKI AND SKI BINDING

(75) Inventors: Markus Krumbeck, Garmisch-Partenkirchen (DE); Michael Mangold, Farchant (DE)

(73) Assignee: Marker Deutschland GmbH, Eschenlohe (DE)

( * ) Notice: Subject to any disclaimer, the term of this patent is extended or adjusted under 35 U.S.C. 154(b) by 355 days.

(21) Appl. No.: 10/636,847

(22) Filed: Aug. 7, 2003

(65) Prior Publication Data

US 2005/0073131 A1 Apr. 7, 2005

(30) Foreign Application Priority Data

Aug. 7, 2002 (DE) ..... 102 36 152

(51) Int. Cl.
*A63C 5/07* (2006.01)

(52) U.S. Cl. ..... 280/607; 280/11.14

(58) Field of Classification Search ..... 280/601, 280/602, 607, 11.14
See application file for complete search history.

(56) References Cited

U.S. PATENT DOCUMENTS 5,129,668 A * 7/1992 Hecht ..... 280/607
5,211,418 A * 5/1993 Scherubl ..... 280/618
5,251,923 A 10/1993 Stepanek et al.
5,326,126 A * 7/1994 Ruffinengo ..... 280/602
5,360,229 A * 11/1994 Arduin et al. ..... 280/617
5,362,085 A * 11/1994 Stepanek et al. ..... 280/602
5,395,132 A * 3/1995 Abondance et al. ..... 280/607
5,437,468 A * 8/1995 Schenner ..... 280/602
5,464,242 A 11/1995 Commier et al.
5,480,175 A * 1/1996 Astier et al. ..... 280/607
5,597,170 A * 1/1997 Le Masson et al. ..... 280/602
5,704,628 A * 1/1998 Boehm et al. ..... 280/602
5,758,894 A * 6/1998 Maggiolo ..... 280/602
5,845,923 A * 12/1998 Zanco ..... 280/607
5,915,719 A * 6/1999 Bauvois ..... 280/607
6,182,998 B1 * 2/2001 Huyghe et al. ..... 280/602
6,193,262 B1 * 2/2001 Silva ..... 280/607
6,227,558 B1 * 5/2001 Arduin et al. ..... 280/611
6,581,956 B2 * 6/2003 Kruajitch ..... 280/618
6,616,171 B2 * 9/2003 Kruajitch ..... 280/607
6,676,151 B2 * 1/2004 Mangold et al. ..... 280/602
6,679,513 B1 * 1/2004 Emig et al. ..... 280/602
6,729,640 B1 * 5/2004 Sedlmair et al. ..... 280/602
6,779,810 B1 * 8/2004 Mangold ..... 280/634
6,857,653 B2 * 2/2005 Wilson ..... 280/602
6,883,823 B2 * 4/2005 Riepler et al. ..... 280/602

(Continued)

FOREIGN PATENT DOCUMENTS

AT 27/82 3/1982

(Continued)

*Primary Examiner*—Jeff Restifo
(74) *Attorney, Agent, or Firm*—D. Peter Hochberg; Sean Mellino

(57) ABSTRACT

A combination of a ski and a ski binding wherein a long part extends in the longitudinal direction of a ski, the long part being fixed at one end and movable at the other end in response to movement of the ski, with a damping device having a fixed part fixed to the ski and a movable piston movable in response to bending of the ski, and an easily removable adapter device for changing the piston. The fixed part of the long part can be changed in length. Guiding structure can also be provided for guiding movement of the long part on the ski.

20 Claims, 6 Drawing Sheets

U.S. PATENT DOCUMENTS

| | | | | |
|---|---|---|---|---|
| 6,896,284 | B2 * | 5/2005 | Kruajitch | 280/607 |
| 2001/0042971 | A1 * | 11/2001 | Krauajitch | 280/611 |
| 2003/0193169 | A1 * | 10/2003 | Holzinger et al. | 280/607 |
| 2004/0178606 | A1 * | 9/2004 | Ashley | 280/602 |
| 2005/0006875 | A1 * | 1/2005 | Donze et al. | 280/602 |

FOREIGN PATENT DOCUMENTS

| | | |
|---|---|---|
| DE | 28 33 393 | 2/1980 |
| EP | 0 639 392 | 3/1997 |
| EP | 0 492 658 B1 | 6/1997 |

* cited by examiner

COMBINATION OF SKI AND SKI BINDING

BACKGROUND OF THE INVENTION

1. Field of the Invention

The invention relates to a combination of ski and ski binding, in which bending movements of the ski can be influenced, or varied, by means of a long part which extends in the longitudinal direction of the ski outside, or above, a neutral bending plane of the ski and is essentially resistant to tensile and shear forces and which has a part, in particular an end part, which is arranged or can be attached in a fixed manner on the ski and at least one part which is spaced from said part in the longitudinal direction of the ski and is movable in the longitudinal direction of the ski and which can be connected in an essentially fixed manner to an associated part of a damping device consisting essentially of two parts movable relative to one another in the longitudinal direction of the ski, the other part of which, which is movable relative to the long part, is or can be connected to an abutment fixed on the ski.

2. Description of the Related Art

From EP 0 492 658 A1, a plate arrangement which can be mounted between the ski and the ski bindings is known, which has a flexible plate which is fixed on the ski at its one end arranged below the heel-side ski binding unit and is otherwise and in particular at its other end arranged below the toe-side binding unit guided displaceably relative to the ski in the longitudinal direction thereof. As soon as the ski performs bending movements, this displaceable end of the plate moves relative to the upper side of the ski in the longitudinal direction of the ski because the plate has a relatively great spacing from the neutral bending plane of the ski. According to EP 0 492 658 A1, in order for it to be possible to damp the bending movements of the ski, a hydraulic damper can be arranged between that end of the plate which is displaceable in the longitudinal direction of the ski and an abutment fixed on the ski.

A ski with variable handling characteristics is known from DE-OS 28 33 393. To this end, at least one pull and push rod, which is flexible with regard to the bending movements of the ski, is arranged in the ski above the neutral bending plane of the ski. This push and pull rod is, with one of its ends, attached to one ski end in a fixed manner in relation to the ski. The other end of the rod is, in the central area of the ski, i.e. below the binding mounting area intended for the arrangement of the ski binding, coupled to a hydraulic damper and spring unit which is arranged between said end of the push and pull rod and an abutment fixed on the ski.

Another ski with a device for damping bending stresses forms the subject of EP 0 639 392 B1. In this case, a flat-band-like plate, one end of which is connected to the ski in a fixed manner in relation to the ski, while the other end is fastened to the upper side of the ski with interposition of an elastomer body, is arranged on the upper side of the ski in each case in front of and/or behind the area of the ski binding. As soon as the ski performs bending movements, the latter end of the plate moves relative to the upper side of the ski in the longitudinal direction of the ski, the elastomer body being subjected to shear stress while damping the bending movement of the ski.

BRIEF SUMMARY OF THE INVENTION

It is now an object of the invention to develop a combination of ski and ski binding of the type indicated in the introduction in such a way that, depending on the requirements of the skier, bending movements of the ski can be influenced in different ways or remain uninfluenced.

According to the invention, this object is achieved by virtue of the fact that the ski and/or the ski binding and/or at least one supporting or holding part retaining the ski binding or a ski binding part on the ski are prepared for subsequently receiving in a fixed manner on the ski that part of the damping device which is movable relative to the long part and/or that part of the long part which is fixed on the ski, and that part of the long part which is movable relative to the ski and that part of the damping device which is assigned to the long part can be or are coupled detachably to one another, and that the long part has an effective length exceeding the length of the ski binding or of the binding area on the ski and/or projects with one end beyond the ski binding or the binding area in the longitudinal direction of the ski.

The invention is based on the general idea of dimensioning or arranging elements serving to influence bending movements of the ski in such a way that they on the one hand interact with comparatively greatly flexing ski areas and on the other hand can be mounted or demounted together with or using parts of the ski binding or associated holding parts. This affords the opportunity of adapting the degree of influence of the bending movements of the ski to the skier concerned, and in particular in the course of mounting the ski bindings which in any case have to be adjusted individually to size and weight of the skier. A particular advantage of the invention resides moreover in the fact that subsequent alterations or retrofitting operations are possible at any time. A skier does therefore not have to make a final decision about the provision of the combination of ski and ski binding when selecting the ski.

According to a first preferred embodiment of the invention, provision is made that the long part is guided outside, in particular relatively far in front of, a binding area of the ski in the longitudinal direction of the ski in a channel in the ski and is or can be arrested in a fixed manner on the ski at its end remote from the binding area of the ski, and that that part of the damping device on the long-part side can be coupled to that end of the long part accessible in the binding area and the other part of the damping device can be coupled to a ski binding part or a supporting or holding part of the ski binding. As the damping device is retained on ski binding parts or supporting or holding parts of the ski binding, a damping device adapted to the size and the weight and also to the ski concerned can be mounted or retrofitted without further action.

Equally, any damping device which may be present can be demounted easily.

The channel of the ski can be designed in diverse forms. On the one hand, the possibility exists of arranging this channel below the upper side of the ski and thus invisibly.

Instead of this arrangement of the channel integrated into the ski, an arrangement in which the parts forming the channel are arranged on the upper side of the ski or protruding above the upper side of the ski is also conceivable.

In particular, the channel can also be formed by guide parts fixed on the ski which are separate from one another and in which the long part is held displaceably in the longitudinal direction of the ski.

In another embodiment, the long part passes through a free space between the upper side of the ski and the ski bindings or supporting or holding parts of the ski bindings in such a way that the two ends of the long part project forward and rearward beyond the binding area in the longitudinal direction of the ski, one end of the long part being secured in a fixed manner on the ski and the other end being connected to that part of the damping device on the long-part side, the other part of which is retained in a fixed manner on the ski.

For securing the one end of the long part in a fixed manner on the ski and retaining the one part of the damping device in a fixed manner on the ski, in each case one or more fastening points can be prepared on the ski, in order for it to be possible to vary the effective length of the long part or the position of the effective area of the long part relative to the ski.

If appropriate, the ski can be equipped with guide rails for the ski bindings or their holding parts. The ski bindings or their holding parts can thus in principle be mounted on the ski virtually without tools in a manner known per se. It is known, for example, to arrange the ski bindings in said rails in the manner of sliders which are then, by means of coupling elements, held in the longitudinal direction of the ski on an abutment part arranged between the ski binding units and fixed to the rails on the ski.

According to a further preferred embodiment of the invention, the rails on the ski can be extended into the vicinity of one end of the ski, in particular the front ski end. This creates an opportunity of fixing the long part virtually anywhere in the area of said rails.

In fundamentally the same way, the damping device can be retained on the rails on the ski. Instead of this, however, it is also possible to hold the damping device indirectly on the rails by virtue of one of the ski binding parts or the abutment part serving for retaining the ski binding units and fixed to the guide rails on the ski being used for retaining that part of the damping device which is remote from the long part.

Thus, the present invention relates to the placing of a damper any place on a ski, and not just in the location of the ski binding. In the cases where the damper has a piston, the piston is not longer restricted to being located with the binding but can be located outside of the binding area.

BRIEF DESCRIPTION OF THE SEVERAL VIEWS OF THE DRAWINGS

With regard to preferred features of the invention, reference is moreover made to the claims and the following description of the drawing, with reference to which especially preferred embodiments of the invention are described in greater detail, and in which

DETAILED DESCRIPTION OF THE INVENTION

Figure 1:
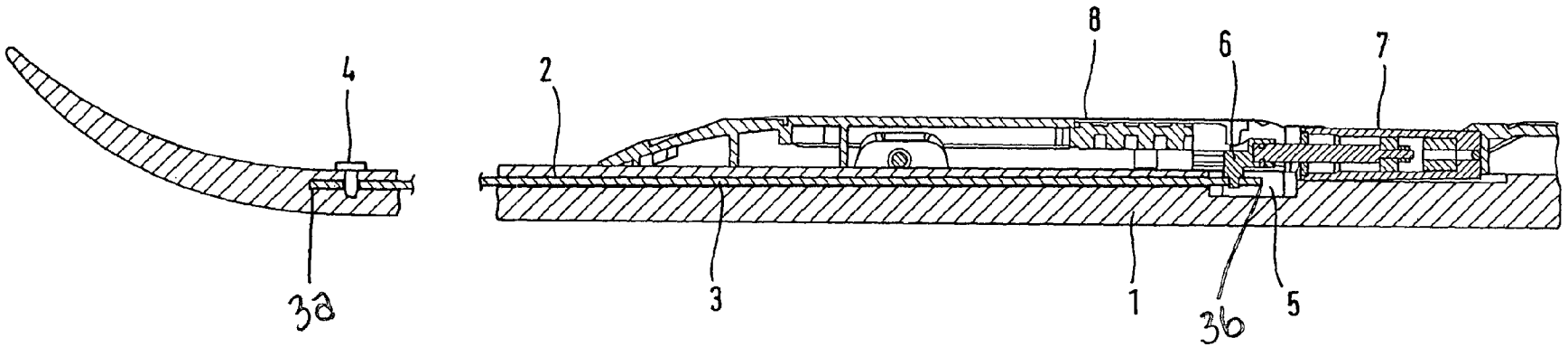
FIG. 1 shows a diagrammatically represented longitudinal section of a first embodiment, in which the long part is arranged in a concealed manner in the ski.

According to FIG. 1, an elongate channel 2 is arranged inside a ski 1, in particular, in the example illustrated, inside the front half of the ski 1, and in particular below the upper side of the ski but above a neutral bending plane of the ski, inside which neither compression nor extension occurs when bending movements of the ski take place.

A flat-band-like long part 3, which is flexible in relation to the bending movements of the ski 1 but is capable of transmitting relatively great tensile and shear forces in its longitudinal direction, can be inserted into this channel 2.

The long part 3 is, in its fixed end area 3*a*, that is, the end area facing the front ski end, fixed in the longitudinal direction of the ski, for example by means of a pin 4 which can be inserted into a vertical receiving bore in the ski 1 and at the same time passes through a vertical bore in the long part 3.

If appropriate, a number of mutually corresponding bores can be provided in the ski 1 and in the long part 3, so that the long part 3 can be secured in a fixed manner on the ski at a greater or smaller distance from the front end of the ski.

The channel 2 ends in an upwardly open cavity 5 in the ski 1, in which one end, free end 3*b*, of the long part 3 is accessible. This end 3*b* of the long part 3 is connected, by means of an adapter piece 6 which is preferably mountable without tools, to the piston rod 7*a* of a damper device 7 designed as a piston/cylinder unit, the cylinder 7*b* of which is received positively and immovably in a corresponding recess in a plate arrangement 8 which is arranged in a fixed manner on the upper side of the ski and serves to receive or retain toe-side and heel-side ski binding units (not illustrated). Other types of dampering units could be used. These devices contract upon receiving impact forces and return to a rest condition over a period of time.

When the front end of the ski 1 performs bending movements in the upward or downward direction relative to the central area of the ski during skiing, that end of the long part 3 projecting into the cavity 5 necessarily moves in the longitudinal direction of the ski because the channel 2 and thus the long part 3 are arranged above the neutral bending plane of the ski 1. These longitudinal movements lead to corresponding travel of the piston of the damping device 7, so that said bending movement of the ski is damped according to the working characteristic of the damping device 7. The piston travel of the damping device 7 and thus the damping effect are greater the greater the effective length of the long part 3. This effective length is determined by the position of the pin 4 which can be arranged at a greater or smaller distance from the cavity 5 in the ski 1.

Figure 2:
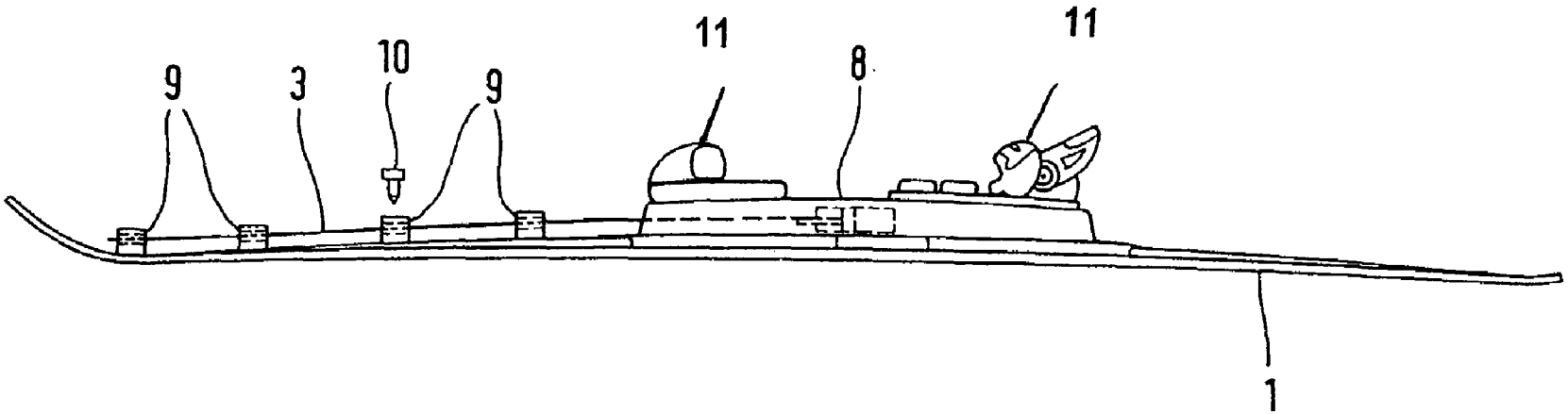
FIG. 2 shows a modified embodiment with the long part arranged above the ski.

The embodiment illustrated in FIG. 2 differs from the embodiment in FIG. 1 above all in that the long part 3 is arranged above the upper side of the ski and is guided displaceably in the longitudinal direction of the ski in guide parts 9 arranged in a fixed manner on the upper side of the ski, it being possible for the long part 3 to be secured in a fixed manner in the longitudinal direction of the ski on one or more of the guide parts 9 by a pin 10. To this end, this pin 10 passes through a bore designed in the guide part concerned and also a bore aligned therewith in the long part 3.

An appropriate free space is designed between the upper side of the ski and the plate arrangement 8 for the ski binding units 11 in such a way that the long part 3 projects into the plate arrangement 8 displaceably in the longitudinal direction of the ski and there is again connected via an adapter piece 6 to the piston of the damper device 7 accommodated inside the plate arrangement.

The resulting functioning is in principle the same as in the embodiment in FIG. 1.

Figure 3:
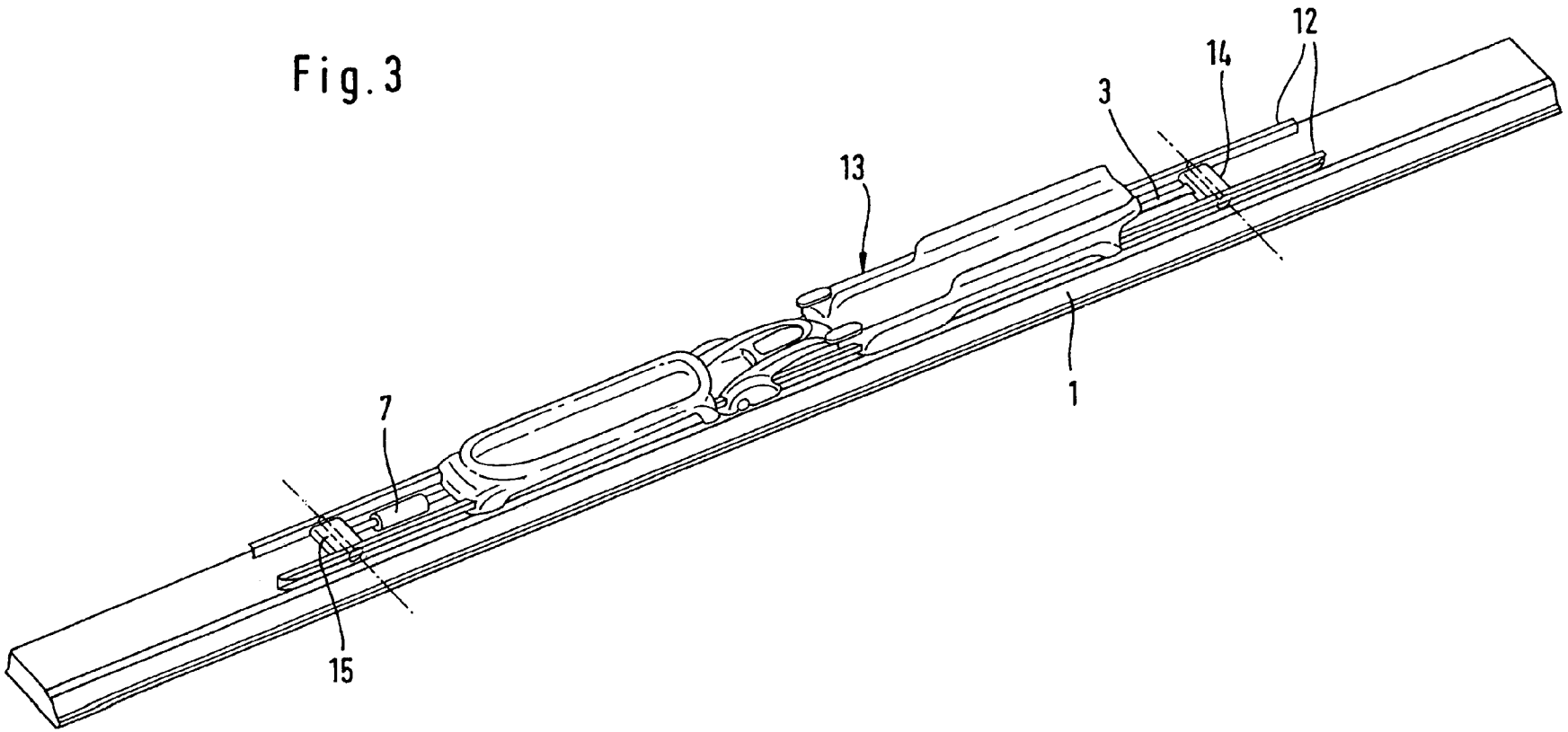
FIG. 3 shows a perspective illustration of an arrangement with guide rails on the ski for retaining ski binding parts or parts on the ski binding and also for retaining the long part and the damping device.

In the embodiment illustrated in FIG. 3, parallel guide rails 12, into which a plate arrangement 13 for receiving ski binding units (not illustrated in greater detail) can be inserted, are arranged on the ski 1. This plate arrangement 13 is designed in three parts for example, a front plate part of the plate arrangement 13 in the longitudinal direction of the ski receiving a toe-side ski binding unit and a rear plate part of the plate arrangement 13 in the longitudinal direction of the ski receiving a heel-side ski binding unit. A central plate part of the plate arrangement 13 can be fixed in the longitudinal direction of the ski on the guide rails 12 and can be connected adjustably to the two other plate parts via coupling means (not illustrated), so that the spacing of the ski binding units on the two other plate parts can be adapted to the boot size concerned.

In the example in FIG. 3, the guide rails 12 have a length which is clearly greater than the adjustment range for the front and rear plate parts which is necessary for adaptation to the boot sizes.

An adequate free space remains between the upper side of the ski and the plate arrangement 13 in such a way that the long part 3, the ends of which facing away from one another project toward the front and toward the rear beyond the plate arrangement 13 in the longitudinal direction of the ski in the example in FIG. 3, can be arranged here.

One end of the long part 3 is fastened to a slider 14 which can be secured on the guide rails 12 by means of a fixing pin. The other end of the long part 3 is connected to the piston of the damping device 7, the cylinder of which is fastened to another slider 15 which can likewise be fixed to the guide rails 12 by means of a fixing pin.

As the guide rails 12 are clearly arranged above the neutral bending plane of the ski 1, the spacing between the sliders 14 and 15 varies when the ski 1 performs bending movements. This change in spacing of the sliders 14 and 15 gives rise to corresponding piston travel of the damper device 7, so that the bending movements of the ski can again be appropriately damped.

In principle, the possibility exists of fixing the sliders 14 and 15 at different positions on the guide rails 12, so that the bending movements of selectable portions of the ski 1 are transmitted to the damper device 7 and accordingly become effective in terms of damping. If appropriate, the long part 3 itself can be connected in a fixed manner to the slider 14 at different positions, so that the effective length of the long part 3 can also be varied or adjusted.

Figure 4:
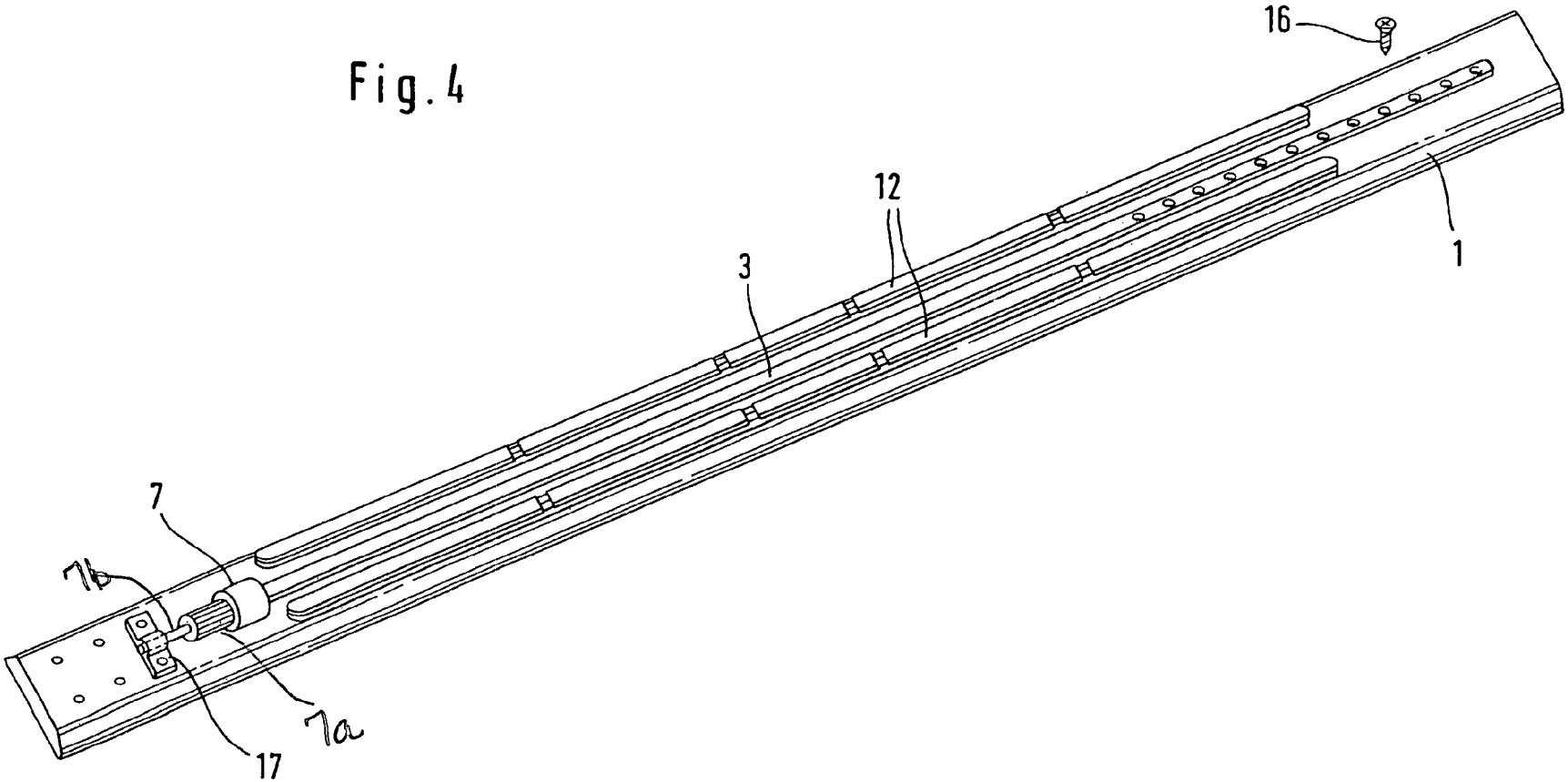
FIG. 4 shows a perspective illustration of a modified embodiment, in which the long part and the damping device can be anchored at prepared fastening points of the ski.

FIG. 4 shows that the guide rails 12 provided for the plate arrangement 13 (not illustrated in FIG. 4) can also have a relatively short length when that end of the damper device 7 remote from the long part and also that end of the long part 3 remote from the damper can be secured directly on the ski 1 at correspondingly prepared fixing points. In the example illustrated, the long part 3 has several bores to this end, which correspond to corresponding bores in the ski 1 and are designed for receiving a fixing pin 16 or a fixing screw. This fixing pin~6 or the fixing screw is inserted into mutually corresponding bores of the long part 3 and of the ski 1. In a similar way, an abutment 17 assigned to the damper device 7 can be fixed at different positions on the ski by pins or screws.

Figure 5:
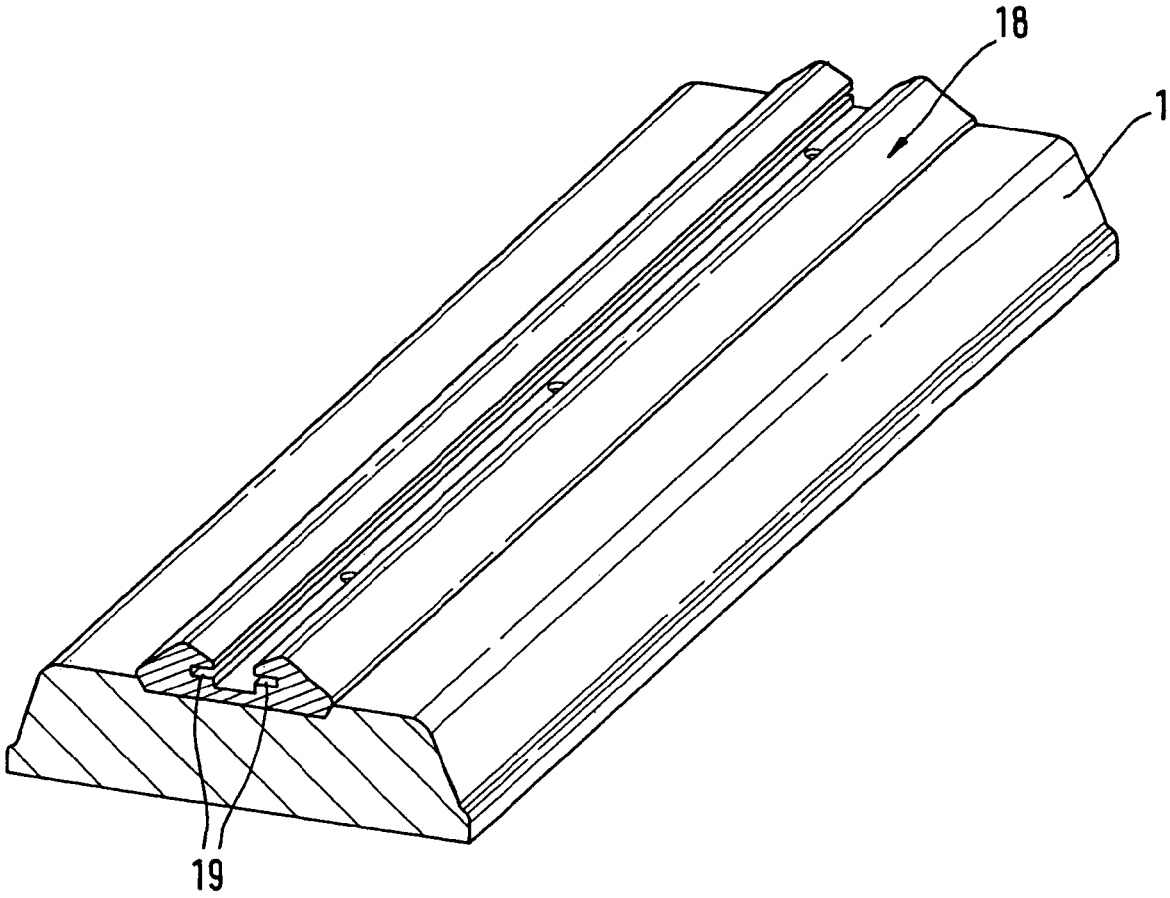
FIG. 5 shows a perspective illustration of a ski with a guide profile for the long part.

In all the embodiments described above, the long part 3 can also, if appropriate, and departing from the figures described above, be guided displaceably in a guide strip 18 on the ski, as is illustrated in FIG. 5. This guide strip 18 has guide grooves 19 which face one another with their openings and receive displaceably the longitudinal edges of the generally flat-band-like long part 3.

In the example in FIG. 5, the guide strip is arranged essentially lying on the upper side of the ski.

Figure 6:
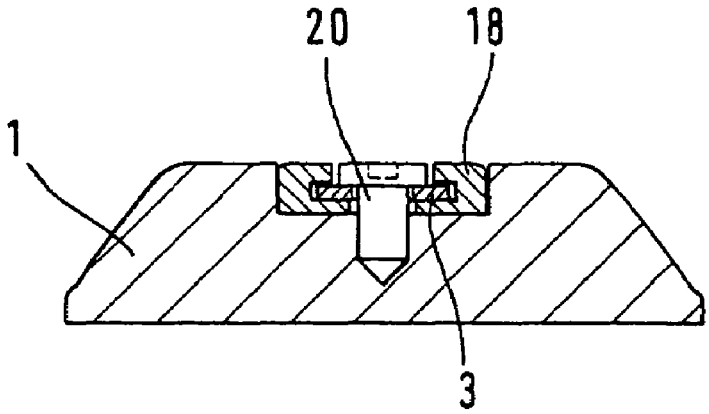
FIG. 6 shows a modified design and arrangement of the guide profile.

FIG. 6 shows by way of example the additional possibility of arranging the guide strip 18 sunk into the upper side of the ski.

Moreover, FIG. 6 illustrates the possibility of fixing the flat-band-like long part 3 guided in the guide strip 18 to the ski 1 to the guide strip 18 by means of a pin 20 which passes through mutually aligned bores in the long part 3, in the guide strip 18 and in the ski 1.

Figure 7:
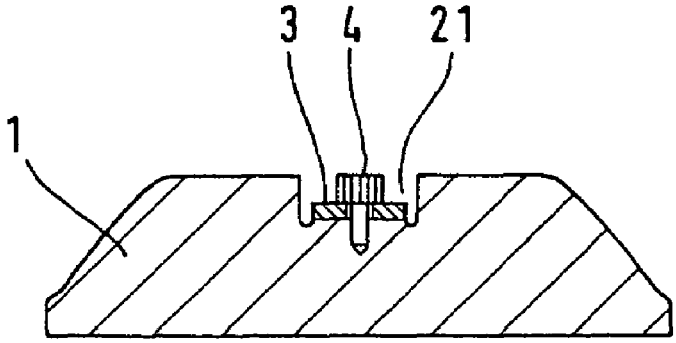
FIG. 7 shows a cross section of a ski with the long part integrated into the ski contour.

FIG. 7 shows the possibility that, instead of the channel 2 in FIG. 1 arranged below the upper side of the ski, a channel 21 open to the upper side of the ski can also serve in the ski 1 for receiving the long part which can again be fixed to the ski 1 by means of a pin 4.

The invention claimed is:

1. A combination of a ski having a neutral bending plane and a ski binding of predetermined length attached to a binding area of said ski, said combination comprising:

a long part extending in a longitudinal direction of said ski and being subject to bending movement with said ski, said long part being spaced from the neutral bending plane of said ski and having a fixed end fixed relative to said ski and a movable portion movable relative to said ski in response to bending of said ski;

a fixing apparatus for fixing said fixed end of said long part to said ski; and a damping device comprising a fixed part and a movable part damping the bending movement of said ski;

an accessible part of said ski binding for providing access to said ski binding; and an adapter device for attaching said movable portion of said long part to said movable part of said damping device, said adapter device being located in said accessible part of said ski binding for enabling the mounting of said adapter device to connect said long part and said movable part of said damping device without tools;

said movable part of said damping device moving longitudinally on said ski relative to said fixed part of said damping device in response to the bending of said ski to dampen the bending of said ski;

said long part having at least one end being longitudinally spaced from said binding area of said ski.

2. A combination of a ski and a ski binding as set forth in claim 1 wherein said fixing apparatus fixes said fixed end of said long part at a location longitudinally spaced from said binding area.

3. A combination of a ski and a ski binding according to claim 1 and further comprising a supporting part fixed to said ski binding area of said ski for fixing said ski binding to said ski, said fixed part of said damping device being attached to said supporting part.

4. A combination of a ski and a ski binding according to claim 1 wherein said damping device is located outside of said binding area of said ski.

5. A combination of a ski and a ski binding according to claim 4 wherein said long part has a length exceeding the length of said binding area, and the opposite ends of said long part being located on opposite sides of said binding area.

6. A combination of a ski and a ski binding according to claim 4 wherein said damping device is located forward of said binding area.

7. A combination of a ski and a ski binding according to claim 1 wherein said damping device comprises a cooperating piston and a cylinder, wherein said cylinder is the fixed part of said damping device and said piston is the movable part of said damping device.

8. A combination of a ski and a ski binding according to claim 1 wherein said ski binding further includes a plate arrangement fixed relative to said ski, and said fixed part of said damping device being fixedly mounted in said plate arrangement.

9. A combination of a ski and a ski binding according to claim 1 and further comprising guide structure extending longitudinally along said ski receiving the movable portion of said long part for guiding the moving of said movable portion in response to the bending of said ski.

10. A combination of a ski and a ski binding according to claim 1 wherein said long part is a band, and further comprising a guide structure mounted on said ski and for guiding the movable portion of said long part during the bending of said ski.

11. A combination of a ski and ski binding according to claim 1 and further comprising guide parts arranged in a fixed manner in a longitudinal direction of the ski for guiding said long part displaceably in the longitudinal direction, and structure for cooperating with said guide parts for securing said long part in a fixed manner in the longitudinal direction of said ski.

12. A combination of a ski having a neutral bending plane and a ski binding area and a ski binding of predetermined length attachable in the ski binding area to a bending area of said ski, said combination comprising:

a long part attachable to said ski and extending in the longitudinal direction of the ski above the neutral plane of the ski, and being resistant to tensile and shear forces, said long part having a fixed portion and a movable portion, said long part having long part fixing structure;

ski fixing structure associated with said ski for cooperating with said long part fixing structure to fix a selected part along part of the length of said long part, to secure in a fixed manner a selected fixed portion of said long part to said ski;

a damping device for damping vibrations of said combination, said damping device having two parts movable relative to each other in the longitudinal direction of the ski, one of said parts being fixed relative to the ski and the other of said parts being fixed to the movable portion of said long part;

at least one supporting part for retaining at least a part of the ski binding on the ski and for fixing at least one of said fixed portion of said long part and said other part of said damping device on the ski;

said movable portion of said long part and said other part of said damping device being detachably coupleable to each other; and said long part having a length greater than the length of said ski binding and the ski binding area.

13. A combination of a ski and a ski binding according to claim 12 and further comprising a pair of parallel guide rails extending longitudinally along opposite sides of said ski for supporting said ski binding, and said fixed part of said damping device being fixed at one part of said ski by said ski fixing structure, said long part extending from said fixed portion between said guide rails, and said damping device being located near the other end of said guide rails, wherein the other of said parts of said damping device being fixed to the movable portion of said long part.

14. A combination of ski and ski binding, in which bending movements of the ski can be influenced, or varied, by means of a long part which extends in the longitudinal direction of the ski outside, or above, a neutral bending plane of the ski and is essentially resistant to tensile and shear forces and which has a part or end part which is arranged or can be attached in a fixed manner on the ski and at least one part which is spaced from said part in the longitudinal direction of the ski and is movable in the longitudinal direction of the ski and which can be connected in an essentially fixed manner to an associated part of a damping device consisting essentially of two parts movable relative to one another in the longitudinal direction of the ski, the other part of which, which is movable relative to the long part, is or can be connected to an abutment fixed on the ski, wherein the ski and/or the ski binding and/or at least one supporting or holding part retaining the ski binding or a ski binding part on the ski are prepared for subsequently receiving in a fixed manner on the ski that part of the damping device which is movable relative to the long part and/or that part of the long part which is fixed on the ski, and that part of the long part which is movable relative to the ski and that part of the damping device which is assigned to the long part can be or are coupled detachably to one another, and wherein the long part has an effective length exceeding the length of the ski binding or of the binding area on the ski and/or projects with one end beyond the ski binding or the binding area in the longitudinal direction of the ski and is there secured in a fixed manner on the ski or connected to the damping device.

15. The combination as claimed in claim 14, wherein the long part is guided in front of or behind the binding area of the ski in the longitudinal direction of the ski in a channel in the ski and is or can be arrested in a fixed manner on the ski at its end remote from the binding area.

16. The combination as claimed in claim 14, wherein the damping device is arranged in the binding area, that part of the damping device which is remote from the long part being fixed or fixable to a part on the binding.

17. The combination as claimed in claim 14, wherein the long part passes through a clearance space between the upper side of the ski and parts on the ski binding in the longitudinal direction of the ski.

18. The combination as claimed in claim 14, wherein that part of the long part which is fixed on the ski or that part of the damping device which is remote from the long part can be fixed to guide rails on the ski which are provided and designed for receiving and retaining parts on the ski binding or the ski binding.

19. The combination as claimed in claim 14, wherein the effective length of the long part is variable.

20. The combination as claimed in claim 14, wherein it is possible to move or adjust the effective area of the long part relative to the ski in the longitudinal direction of the ski.

* * * * *